US006746343B2

(12) United States Patent
Yoneyama

(10) Patent No.: US 6,746,343 B2
(45) Date of Patent: Jun. 8, 2004

(54) IRON GOLF CLUB HEAD

(75) Inventor: Kosaku Yoneyama, Tokyo (JP)

(73) Assignee: Yonex Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/351,441

(22) Filed: Jan. 27, 2003

(65) Prior Publication Data

US 2003/0144080 A1 Jul. 31, 2003

(30) Foreign Application Priority Data

Jan. 29, 2002 (JP) ..... 2002-019394

(51) Int. Cl.[7] ..... A63B 53/04

(52) U.S. Cl. ..... 473/342; 473/346; 473/349; 473/350

(58) Field of Search ..... 473/334, 335, 473/336, 337, 338, 339, 345, 346, 349, 350, 342

(56) References Cited

U.S. PATENT DOCUMENTS

| | | | | |
|---|---|---|---|---|
| 4,511,145 A | * | 4/1985 | Schmidt | 473/346 |
| 4,938,470 A | * | 7/1990 | Antonious | 473/242 |
| 5,014,993 A | | 5/1991 | Antonious | |
| 5,048,835 A | | 9/1991 | Gorman | |
| 5,176,384 A | * | 1/1993 | Sata et al. | 473/329 |
| 5,595,552 A | | 1/1997 | Wright et al. | |
| 5,718,641 A | * | 2/1998 | Lin | 473/224 |
| 6,030,295 A | * | 2/2000 | Takeda | 473/345 |
| 6,422,951 B1 | * | 7/2002 | Burrows | 473/328 |
| 6,454,665 B2 | * | 9/2002 | Antonious | 473/346 |
| 2001/0001774 A1 | | 5/2001 | Antonious | |

FOREIGN PATENT DOCUMENTS

| | | |
|---|---|---|
| EP | 0838245 A2 | 4/1998 |
| JP | 9-192273 | 7/1997 |
| JP | 10-248970 | 9/1998 |

* cited by examiner

*Primary Examiner*—Sebastiano Passaniti
(74) *Attorney, Agent, or Firm*—Wenderoth, Lind & Ponack L.L.P.

(57) ABSTRACT

An iron golf club head includes a head body and a front face plate made of a highly resilient metal which is attached to a front of the head body. A thick-walled portion is formed in the back of the lower central part of the front face plate. Multiple narrow ribs are formed to radially extend from the thick-walled portion toward the upper and lateral peripheral parts of the front face plate, and the ribs have a thickness not substantially exceeding the thickness of the thick-walled portion. Broad thin-walled portions arc formed between the adjacent ribs.

20 Claims, 2 Drawing Sheets

IRON GOLF CLUB HEAD

CROSS-REFERENCE TO RELATED APPLICATIONS

The present application claims priority of Japanese Patent Application No. 2002-19394 filed on Jan. 29, 2002, which is incorporated here

BACKGROUND OF THE INVENTION

1. Field of the Invention

The present invention relates to an iron golf club head which has a face plate made of lightweight metal such as a titanium alloy attached on a front face of a head body.

2. Related Art

As disclosed in Japanese Patent Application Laid-open Publication No. Hei 9-192273, a conventional iron club head has achieved an improved resilience by making a central portion of the face plate thick, and making a perimeter thereof thin.

However, since this conventional iron club head has a thickened center portion of the face plate, the center of gravity of the entire head is situated at a relatively high position. Thus, the moment of inertia of the club head is reduced by this high position, which therefore impairs ease of swing for players.

The present invention has been made in view of the above problems, and its object is to provide a golf club head which, while maintaining high resilience, also provides a low center of gravity through lowering the weight distribution of the entire head. Thus, the golf club provides a large moment of inertia of the club head for a high trajectory and ease of hit.

SUMMARY OF THE INVENTION

In order to achieve the above and other objects, the present invention provides an iron golf club head comprising a head body and a face plate made of a highly resilient metal attached to a front face of the head body. The face plate comprises a thick-walled portion formed in a lower central part thereof, a plurality of narrow ribs formed to radially extend from the thick-walled portion toward an upper and lateral peripheral parts of the face plate, with each rib having a thickness not substantially exceeding a thickness of the thick-walled portion. A plurality of broad thin-walled portions is also formed between the ribs arranged adjacent to each other.

The thick-walled portion in the lower central part of the face plate may have a substantially semi-circular shape with a linear section of the semi-circle located on the side of a sole section. The plurality of ribs are formed to radially extend from an arc section of the semi-circle.

The thin-walled portions disposed between the plurality of ribs may be formed by pressing each thin-walled portion so that each thin-walled portion has an inner end shaped as an arc having a smaller radius and an outer end shaped as an arc having a larger radius, respectively. For example, the thin-walled portions may be formed by pressing so that each thin-walled portion is shaped in an eggplant-like profile. In other words, each thin-walled portion has an oval shape in which each arc-shaped end is connected by straight, non-parallel edges, and the straight non-parallel edges of each thin-walled portion define the ribs.

The thick-walled portion and the narrow ribs may be formed with a thickness in a range of 2.7 mm to 3.5 mm, and the thin-walled portions are formed with a thickness in a range of 2.0 mm to 2.6 mm.

A back side of the head body may be enclosed by a rear face plate to form a hollow body structure.

Weight members may be disposed in toe and heel sides in a lower back side of the head body.

The face plate may be formed of a titanium alloy.

According to another aspect of the present invention, an iron golf club has a golf club head comprising a head body and a face plate made of a highly resilient metal attached to a front face of the head body. The face plate comprises a thick-walled portion formed in a lower central part thereof, a plurality of narrow ribs formed to radially extend from the thick-walled portion toward upper and lateral peripheral parts of the face plate, with each rib having a thickness not substantially exceeding a thickness of the thick-walled portion. A plurality of broad thin-walled portions is also formed between the ribs arranged adjacent to each other.

BRIEF DESCRIPTION OF THE DRAWINGS

For a more complete understanding of the present invention and the advantages thereof, reference is now made to the following description taken in conjunction with the accompanying drawings wherein.

DETAILED DESCRIPTION OF THE INVENTION

A preferred embodiment of the present invention will be described hereinafter with reference to the accompanying drawings.

Figure 1:
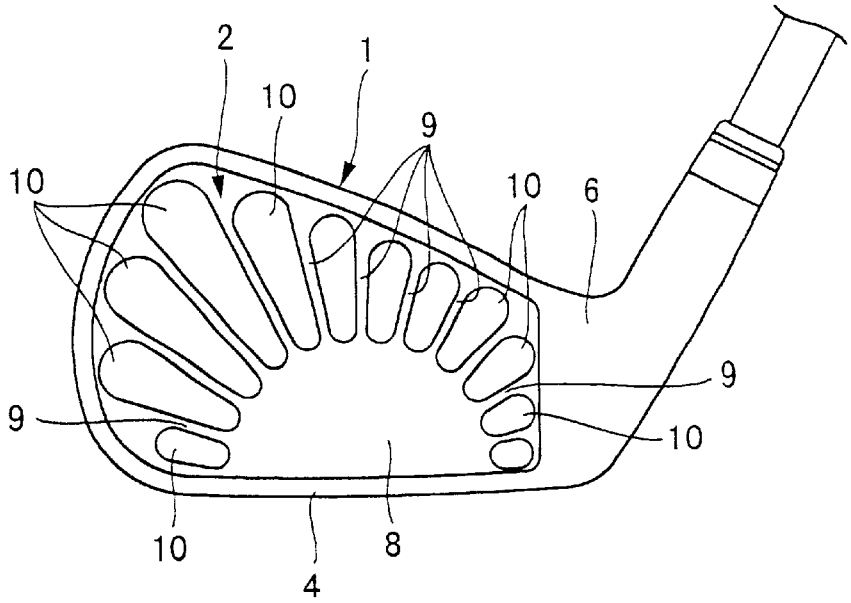
FIG. 1 is a sectional elevation view of a golf club head according to one embodiment of the present invention, showing a concave-convex pattern on a back side of a front face plate.
Figure 2:
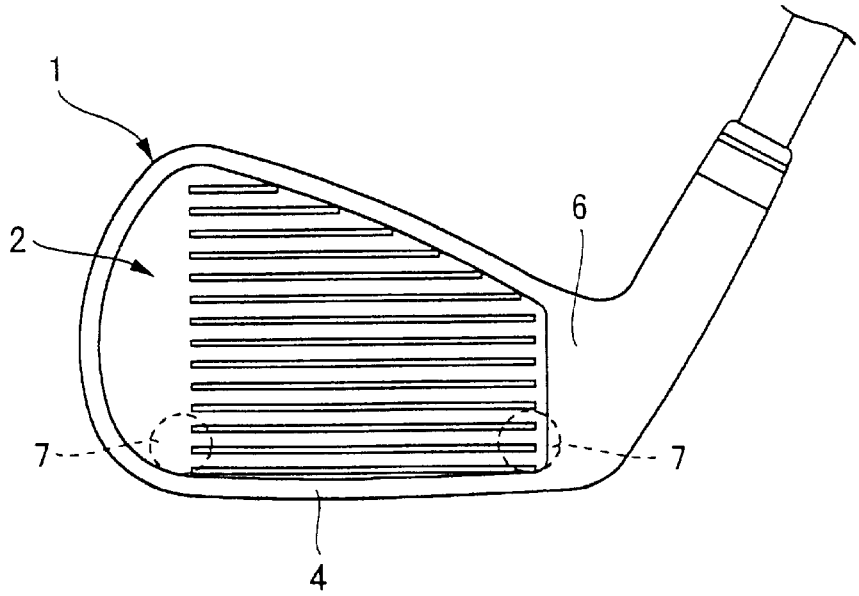
FIG. 2 is an elevation view of a front side of the golf club head shown in FIG. 1.
Figure 3:
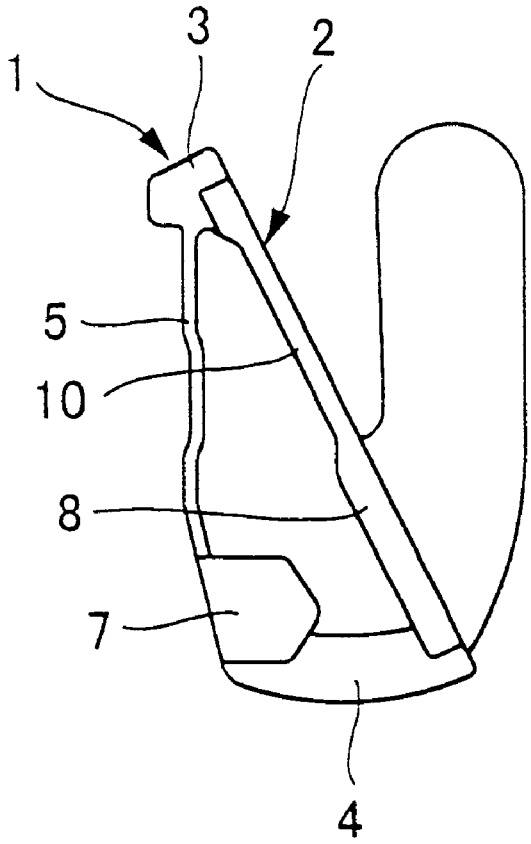
FIG. 3 is a cross sectional side view at the center of the golf club head depicted in FIGS. 1 and 2.

FIG. 1 and FIG. 2 are drawings of the iron golf club head of the present invention. In the sectional elevation view of FIG. 1, the concave-convex pattern on the back surface of the back side of the face plate is shown. FIG. 2 shows the front side of the face plate. FIG. 3 is a cross sectional side view taken along the center of the golf club head of FIG. 2.

The golf club head of the present embodiment basically comprises a head body 1 cast from stainless steel and having an opening at the front, and a front face plate 2 formed from a 6-4 alloy of titanium and fitted to the opening of the head body 1.

The head body 1 is cast as one unitary body which comprises a flange section 3 extending along the periphery from the top side to the toe side thereof, a thickened sole section 4, a heel section, a hosel section 6, and a rear face plate 5 extending from the inner peripheral edges of these sections. The front of the head body 1 is open so that the head body 1 has a hollow body structure. The front face plate 2 is integrally attached, for example by welding, to the periphery of the opening in the head body 1.

On the toe and heel sides in the lower back side of the head body 1, hollow cylindrical holes which are substantially U-shaped are formed, and in these hollow cylindrical holes are inserted tungsten blocks 7 as weight members.

A substantially semi-circular thick-walled portion 8 (in which the linear section of the semi-circle is located on the side of the sole section 4) is formed in the lower central part of the back side of front face plate 2 which includes a sweet spot. A plurality of ribs 9 are formed to radially extend from substantially equally spaced points along the circumferential direction of the arc-shaped peripheral section of the semi-circular portion 8 towards the periphery of the front face plate 2. The parts formed between the ribs 9 are thin-walled portions 10. As shown in FIG. 1, each of the thin-walled portions has an inner and an outer arc-shaped end having a smaller and a larger radius, respectively. In other words, each has an eggplant-like (oval) shape which, as shown in FIG. 1, includes straight, non-parallel edges connecting the arc-shaped ends. The thin-walled portions 10 are formed by pressing, and therefore the boundary part of the eggplant-like shape is curved and each of the shapes is recessed therein. The width of the ribs between the adjacent thin-walled portions 10 is as narrow as about 1.5 mm.

The thickness of the thick-walled portion 8 in the lower central part of the face plate and the ribs is in a range of 2.7 to 3.5 mm, for example 3.0 mm, and the thickness of the thin-walled portions 10 is in a range of 2.0 to 2.6 mm, for example 2.5 mm.

As apparent from the above description, the iron club head of the present embodiment is constructed such that the thick-walled portion 8 of the front face plate 2 is located below its center, and the center of gravity can be made lower than that of a conventional club head. Furthermore, the club head of the present embodiment is constructed such that the thick-walled portion 8 including the sweet spot is surrounded by the thin-walled portions 10 which extend in the outer part of the front face plate and which are reinforced by the narrow rib. Therefore, the club head can have a desired strength and, at the same time, can ensure high resilience.

As described in the preferred embodiment of the present invention, by providing the hollow body structure in which the back side of the head body is enclosed by the rear face plate 5, and by inserting weight members 7 made of, for example, tungsten, in the toe and heel sides in the lower back side of the head body 1, the center of gravity of the entire club head can be located more towards the rear (deeper in the depth direction), and lower than that of a conventional iron club head. Therefore, the present embodiment can provide a golf club which attains a high trajectory for improved distance and ease of swing due to the lower center of gravity design.

Further, since a large moment of inertia of the club head is achieved through its low center of gravity which is attained by lowering the weight distribution of the entire head, the present embodiment can provide a golf club which accomplishes a high trajectory and ease of hit.

Although the preferred embodiment of the present invention has been described in detail, it should be understood that various changes, substitutions and alterations can be made therein without departing from the spirit and scope of the inventions as defined by the appended claims.

What is claimed is:

1. A golf club head comprising:

a head body; and a front face plate made of a highly resilient metal, said front face plate being attached to a front of said head body, said front face plate including:

a thick-walled portion formed at a lower central part of said front face plate;

a plurality of ribs radially extending from said thick-walled portion toward an upper periphery and a lateral periphery of said front face plate, each of said ribs having a thickness not substantially exceeding a thickness of said thick-walled portion; and a plurality of thin-walled portions formed between said ribs and arranged adjacent to each other, each of said thin-walled portions being wider than each of said ribs, each of said thin-walled portions having an arc-shaped inner end and an arc-shaped outer end having a larger radius than said arc-shaped inner end.

2. The golf club head of claim 1, wherein said thick-walled portion has a substantially semi-circular shape including a linear peripheral section located along a sole of said head body, and including an arc-shaped peripheral section, said ribs radially extending from said arc-shaped peripheral section of said thick-walled portion.

3. The golf club head of claim 2, wherein each of said thin-walled portions has a pair of straight edges connecting said arc-shaped inner end and said arc-shaped outer end, said straight edges of each of said thin-walled portions defining said ribs.

4. The golf club head of claim 2, wherein said thick-walled portion and each of said ribs has a thickness in a range of 2.7 mm to 3.5 mm, and each of said thin-walled portions has a thickness in a range of 2.0 mm to 2.6 mm.

5. The golf club head of claim 2, wherein said head body has a rear face plate shaped and arranged to form a hollow body structure.

6. The golf club head of claim 2, further comprising a first weight member at a lower rear toe-side portion of said head body, and a second weight member at a lower rear heel-side portion of said head body.

7. The golf club head of claim 2, wherein said front face plate is made of a titanium alloy.

8. The golf club head of claim 1, wherein each of said thin-walled portions has a pair of straight edges connecting said arc-shaped inner end and said arc-shaped outer end, said straight edges of each of said thin-walled portions defining said ribs.

9. The golf club head of claim 1, wherein said thick-walled portion and each of said ribs has a thickness in a range of 2.7 mm to 3.5 mm, and each of said thin-walled portions has a thickness in a range of 2.0 mm to 2.6 mm.

10. The golf club head of claim 1, wherein said head body has a rear face plate shaped and arranged to form a hollow body structure.

11. The golf club head of claim 1, further comprising a first weight member at a lower rear toe-side portion of said head body, and a second weight member at a lower rear heel-side portion of said head body.

12. The golf club head of claim 1, wherein said front face plate is made of a titanium alloy.

13. The golf club head of claim 1, wherein each of said thin-walled portions is formed by pressing.

14. A golf club comprising:

a golf club head including a head body and a front face plate made of a highly resilient metal, said front face plate being attached to a front of said head body, said front face plate including:

a thick-walled portion formed at a lower central part of said front face plate;

a plurality of ribs radially extending from said thick-walled portion toward an upper periphery and a lateral periphery of said front face plate, each of said ribs having a thickness not substantially exceeding a thickness of said thick-walled portion; and a plurality of thin-walled portions formed between said ribs and arranged adjacent to each other, each of said thin-walled portions being wider than each of said ribs, each of said thin-walled portions having an arc-shaped inner end and an arc-shaped outer end having a larger radius than said arc-shaped inner end.

15. The golf club head of claim 14, wherein said thick-walled portion has a substantially semi-circular shape including a linear peripheral section located along a sole of said head body, and including an arc-shaped peripheral section, said ribs radially extending from said arc-shaped peripheral section of said thick-walled portion.

16. The golf club head of claim 14, wherein each of said thin-walled portions has a pair of straight edges connecting said arc-shaped inner end and said arc-shaped outer end, said straight edges of each of said thin-walled portions defining said ribs.

17. The golf club head of claim 14, wherein said thick-walled portion and each of said ribs has a thickness in a range of 2.7 mm to 3.5 mm, and each of said thin-walled portions has a thickness in a range of 2.0 mm to 2.6 mm.

18. The golf club head of claim 14, wherein said head body has a rear face plate shaped and arranged to form a hollow body structure.

19. The golf club head of claim 14, further comprising a first weight member at a lower rear toe-side portion of said head body, and a second weight member at a lower rear heel-side portion of said head body.

20. The golf club head of claim 14, wherein each of said thin-walled portions is formed by pressing.

* * * * *